US008714706B2

(12) United States Patent
Sudo et al.

(10) Patent No.: US 8,714,706 B2
(45) Date of Patent: May 6, 2014

(54) LIQUID EJECTING APPARATUS AND METHOD OF EJECTING LIQUID

(75) Inventors: Naoki Sudo, Matsumoto (JP); Bunji Ishimoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 546 days.

(21) Appl. No.: 12/454,160

(22) Filed: May 13, 2009

(65) Prior Publication Data

US 2009/0284559 A1 Nov. 19, 2009

(30) Foreign Application Priority Data

May 13, 2008 (JP) ..... 2008-126410

(51) Int. Cl.
*B41J 2/15* (2006.01)
*B41J 2/145* (2006.01)

(52) U.S. Cl.
USPC ..... 347/41

(58) Field of Classification Search
USPC ..... 347/41
See application file for complete search history.

(56) References Cited

U.S. PATENT DOCUMENTS

2003/0043219 A1* 3/2003 Kojima ..... 347/14
2006/0071954 A1* 4/2006 Morooka et al. ..... 347/5
2006/0279597 A1* 12/2006 Ishimoto et al. ..... 347/16

FOREIGN PATENT DOCUMENTS

JP 06166247 A * 6/1994
JP 2002-347286 12/2002
JP 2003-034021 2/2003
JP 2004-066550 3/2004
JP 2004-181698 7/2004

* cited by examiner

*Primary Examiner* — Ryan Lepisto
*Assistant Examiner* — Erin Chiem
(74) *Attorney, Agent, or Firm* — Nutter McClennen & Fish LLP; John J. Penny, Jr.; Christina M. Sperry

(57) ABSTRACT

A liquid ejecting apparatus includes a liquid supplying unit that supplies the liquid, a head unit that has a nozzle row, in which a plurality of nozzles for ejecting the liquid is aligned, a control unit that forms a raster area, in which a plurality of ejection dots in units of the nozzle rows is aligned in a main scanning direction, an ejection amount calculating unit that calculates ejection amounts of the liquid needed for forming the ejection dots, and a division scanning unit that divides the raster area so as to be formed by performing a plurality of head scanning operations in accordance with a transitional change in the ejection amounts that is formed by aligning the ejection amounts calculated by the ejection amount calculating unit in the order in which the ejection dots in units of nozzle rows are formed.

16 Claims, 13 Drawing Sheets

LIQUID EJECTING APPARATUS AND METHOD OF EJECTING LIQUID

BACKGROUND

1. Technical Field

The present invention relates to a liquid ejecting apparatus that ejects liquid, and more particularly, to a liquid ejecting apparatus that has a plurality of nozzles for ejecting liquid supplied from a liquid supplying unit.

2. Related Art

As a representative example of liquid ejecting apparatuses, there are ink jet printers that record a text and a diagram by ejecting ink droplets onto a recording medium having a thin film shape such as a paper sheet or plastic. As other liquid ejecting apparatuses, there are apparatuses that eject various materials in a liquid form that are used for forming a coloring material, an electrode, or the like in a pixel forming area or an electrode forming area of a display manufacturing apparatus that manufactures a liquid crystal display, a plasma display, an organic EL (Electro Luminescence) display, a field emission display (FED), or the like.

In the liquid ejecting apparatuses, when the amount of supply of liquid supplied to the nozzles from a liquid supplying unit is smaller than the ejection amount of the liquid ejected from the nozzles, that is, when the liquid refilling speed is low, there is a problem that a defect of ejection of the liquid in the nozzles occurs. As a countermeasure for the delay of refilling the liquid, in JP-A-2004-66550, technology for controlling formation of dots based on the temperature of a record head that influences the refilling speed in the ink jet printer has been disclosed.

However, sufficient consideration of a countermeasure for the delay of refilling the liquid has not been made. In particular, sufficient consideration of the relationship between the transitional change in the ejection amount and the refilling speed for a case where the liquid is ejected continuously from the nozzles has not been made.

SUMMARY

An advantage of some aspects of the invention is that it provides technology capable of avoiding a defect of liquid ejection due to delay of refilling the liquid.

The invention may be implemented in the following forms or the following applied examples.

APPLIED EXAMPLE 1

According to Applied Example 1 of the invention, there is provided a liquid ejecting apparatus that ejects liquid to an ejection target. The liquid ejecting apparatus includes: a liquid supplying unit that supplies the liquid; a head unit that has a nozzle row, in which a plurality of nozzles for ejecting the liquid supplied commonly from the liquid supplying unit is aligned, and forms the liquid ejected from the plurality of nozzles as ejection dots in units of nozzle rows aligned along the nozzle row in the ejection target; a control unit that forms a raster area, in which a plurality of the ejection dots in units of the nozzle rows is aligned in a main scanning direction, in the ejection target by performing head scanning for moving the head unit relative to the ejection target in the main scanning direction that intersects the nozzle row; an ejection amount calculating unit that calculates ejection amounts of the liquid needed for forming the ejection dots in units of the nozzle rows for each of the ejection dots in units of the nozzle rows that configures the raster area; and a division scanning unit that divides the raster area so as to be formed by performing a plurality of head scanning operations in accordance with a transitional change in the ejection amounts that is formed by aligning the ejection amounts calculated by the ejection amount calculating unit in the order in which the ejection dots in units of nozzle rows are formed. According to the above-described liquid ejecting apparatus, the raster area, in which a defect of liquid ejection due to delay of refill may occur, is divided so as to be formed by performing a plurality of head scanning operations in accordance with the transitional change in the amount of ejection in the nozzle, and accordingly, the defect of liquid ejection due to delay of refill can be avoided.

APPLIED EXAMPLE 2

In the above-described liquid ejecting apparatus, the division scanning unit may be configured to include: a first determining section that performs increment for an evaluation value used for evaluating the transitional change in the ejection amounts for a case where the ejection amount calculated by the ejection amount calculating unit is equal to or larger than a first threshold value; a second determining section that performs decrement for the evaluation value for a case where the ejection amount calculated by the ejection amount calculating unit is equal to or smaller than a second threshold value that is smaller than the first threshold value; a third determining section that maintains the evaluation value at a current value for a case where the ejection amount calculated by the ejection amount calculating unit is smaller than the first threshold value and is larger than the second threshold value; and a fourth determining section unit that divides the raster area so as to be formed by performing a plurality of head scanning operations for a case where the evaluation value added by the first determining section exceeds a predetermined value and an ejection amount exceeding a third threshold value is included in the subsequent ejection amounts, which are calculated by the ejection amount calculating unit, of a predetermined number. In such a case, by setting the parameters based on the refilling characteristics of the liquid ejecting apparatus, need for dividing the scanning operation can be determined efficiently.

APPLIED EXAMPLE 3

In the above-described liquid ejecting apparatus, the division scanning unit may be configured to divide the raster area for one head scanning operation so as to be formed by performing a plurality of head scanning operations in accordance with the transitional change in the ejection amounts that is formed by aligning the ejection amounts calculated by the ejection amount calculating unit in the order in which the ejection dots in units of the nozzle rows are formed in performing the one head scanning operation. In such a case, a defect of ejection of the liquid due to delay of refilling for each one head scanning operation can be avoided.

APPLIED EXAMPLE 4

In the above-described liquid ejecting apparatus, it may be configured that the control unit forms the raster area in the ejection target by performing the head scanning operation in the reciprocating manner, and the division scanning unit includes a second division scanning section that divides the raster area so as to be formed by performing a plurality of head scanning operations in at least one head scanning operation between a head scanning operation performed in the forward movement and a head scanning operation performed in the backward movement, in accordance with the transitional change in the ejection amounts that is formed by aligning the ejection amounts calculated by the ejection amount calculating unit in the order, in which the ejection dots in units of the nozzle rows are formed, from the head scanning operation in the forward movement to the head scanning operation in the backward movement. In such a case, a defect of ejection of the liquid due to delay of refilling in the head scanning operation from the forward movement to the backward movement can be avoided.

APPLIED EXAMPLE 5

In the above-described liquid ejecting apparatus, it may be configured that the division scanning unit includes a raster dividing section that divides the raster area, which is divided so as to be formed by performing the plurality of head scanning operations, in units of rasters in which the ejection dots are aligned in one row in the main scanning direction in the raster area. In such a case, uniformity between a raster area that is divided so as to be formed by performing a plurality of head scanning operations and a raster area that is formed by performing one head scanning operation can be improved.

APPLIED EXAMPLE 6

In the above-described liquid ejecting apparatus, it may be configured that the raster dividing section divides the raster area that is divided so as to be formed by performing the plurality of head scanning operations with two or more adjacent rasters skipped.

APPLIED EXAMPLE 7

In the above-described liquid ejecting apparatus, it may be configured that the raster dividing section divides the raster area that is divided so as to be formed by performing the plurality of head scanning operations with one raster skipped.

APPLIED EXAMPLE 8

According to Applied Example 8 of the invention, there is provided a method of ejecting liquid onto an ejection target by using a control device. The method includes: forming the liquid ejected from a plurality of nozzles in the ejection target as ejection dots in units of nozzle rows that are aligned along a nozzle row by controlling a head unit having the nozzle row, in which a plurality of nozzles for ejecting the liquid commonly supplied from a liquid supplying unit is aligned, by using an ejection control unit that is included in the control device; forming the raster area, in which a plurality of the ejection dots in units of the nozzle rows is aligned in a main scanning direction, in the ejection target by performing a head scanning operation for moving the head unit relative to the ejection target in the main scanning direction intersecting the nozzle row by using a scanning control unit that is included in the control device; calculating ejection amounts of the liquid needed for forming the ejection dots in units of the nozzle rows for each of the ejection dots in units of the nozzle rows that configures the raster area by using an ejection amount calculating unit that is included in the control device; and dividing the raster area so as to be formed by performing a plurality of head scanning operations in accordance with a transitional change in the ejection amounts that is formed by aligning the ejection amounts calculated in the calculating of the ejection amounts in the order in which the ejection dots in units of nozzle rows are formed by using a scanning division unit that is included in the control device. According to the above-described method, the raster area, in which a defect of liquid ejection due to delay of refill may occur, is divided so as to be formed by performing a plurality of head scanning operations in accordance with the transitional change in the amount of ejection in the nozzle, and accordingly, the defect of liquid ejection due to delay of refill can be avoided. In addition, the control device may be configured as a part of the liquid ejecting apparatus or may be configured as a body separated from the liquid ejecting apparatus.

The form of the invention is not limited to a liquid ejecting apparatus. Thus, for example, the invention may be applied to other forms such as a method of controlling a liquid ejecting apparatus and a program for implementing the function of controlling the liquid ejecting apparatus in a computer. The invention is not limited to the above-described forms at all. Thus, it is apparent that the invention may be implemented in various forms without departing from the gist of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

For clarifying the configuration and the operation of the invention described above further, hereinafter, a liquid ejecting apparatus to which an embodiment of the invention is applied will be described. In this embodiment, an ink jet printer that represents an image recording apparatus as one type of a liquid ejecting apparatus will be described as an example.

A. First Embodiment

A1. Configuration Of Printer

Figure 1:
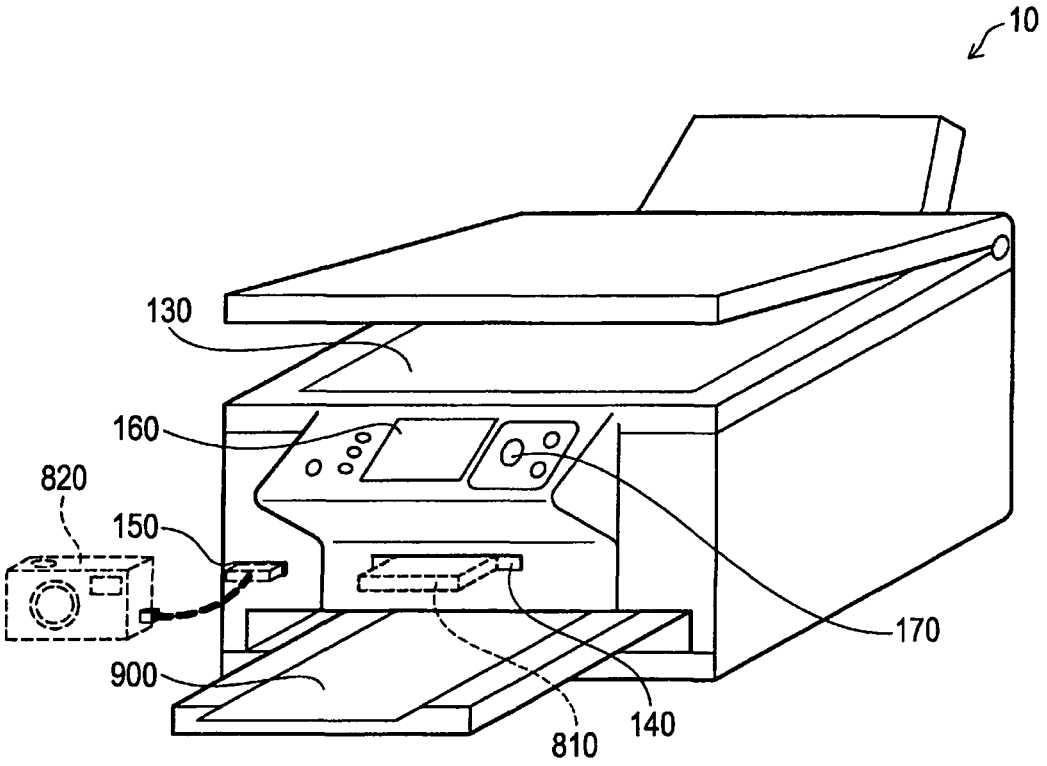
FIG. 1 is an explanatory diagram mainly showing the external configuration of a printer 10 according to an embodiment of the invention.

FIG. 1 is an explanatory diagram mainly showing the external configuration of a printer 10. The printer 10 is an ink jet printer that prints data such as a text or an image by ejecting ink droplets on a printing medium 900 such as a paper sheet or a label. According to this embodiment, the printer 10 has various functions including a scanner, a copier, and the like as so-called a multifunction device.

The printer 10 includes a card slot 140 and a communication connector 150. The card slot 140 of the printer 10 is an interface that is connected to a memory card 810, in which a storage medium such as a flash memory or a small-size hard disk is built in, for data exchange therebetween. The communication connector 150 of the printer 10 is an interface that is connected to an external device 820 such as a personal computer, a digital still camera, or a digital video camera for data exchange therebetween. In this embodiment, the printer 10 has a function for printing image data that is stored in the memory card 810 connected to the card slot 140 or the external device 820 connected to the communication connector 150 in addition to a function for printing data based on a printing request from the external device 820 that is connected to the communication connector 150.

The printer 10 further includes a scanner unit 130, a display 160, and an operation panel 170. The scanner unit 130 of the printer 10 reads out a document placed in a document platen and converts (scans) the document into digital data. The display 160 of the printer 10 displays a text and an image for a user using the printer 10. The operation panel 170 of the printer 10 receives a direction input from a user using the printer 10.

Figure 2:
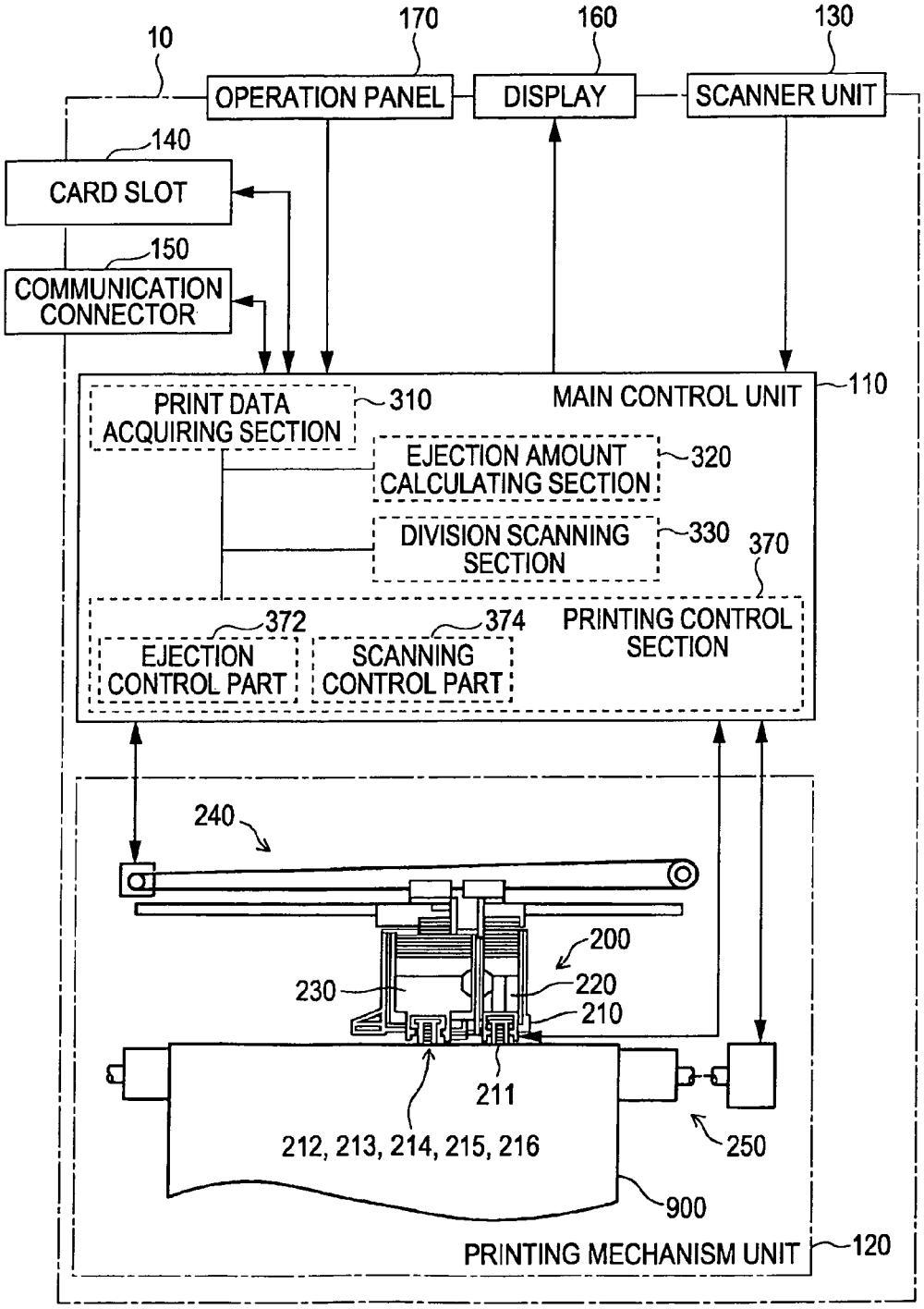
FIG. 2 is an explanatory diagram mainly showing the internal configuration of the printer 10.

FIG. 2 is an explanatory diagram mainly showing the internal configuration of the printer 10. The printer 10 further includes a main control unit 110 that is a control device controlling each unit of the printer 10 and a printing mechanism unit 120 that performs a printing operation for the printing medium 900, in addition to the card slot 140, the communication connector 150, and the like that are described with reference to FIG. 1.

The printing mechanism unit 120 of the printer 10, as shown in FIG. 2, includes a carriage 200, a head unit 210, a carriage driving section 240, and a transport section 250. The carriage driving section 240 of the printing mechanism unit 120 drives the carriage 200 in the main scanning (head scanning) direction on the upper side of a printing medium 900. The transport section 250 of the printing mechanism unit 120 transports a printing medium 900 in the sub scanning direction that intersects the main scanning direction in which the carriage 200 moves.

The carriage 200 of the printing mechanism unit 120 holds the head unit 210 and has ink cartridges 220 and 230 mounted thereon. The ink cartridges 220 and 230 that are mounted on the carriage 200 serve as liquid supplying units that supply ink to the head unit 210. The ink cartridge 220 houses ink of a black color. The ink cartridge 230 houses ink of five colors including a cyan color, a light cyan color, a magenta color, a light magenta color, and a yellow color.

The head unit 210 of the printing mechanism unit 120 includes six ejection heads 211, 212, 213, 214, 215, and 216 for the black color, the cyan color, the light cyan color, the magenta color, the light magenta color, and the yellow color. Each of the ejection heads 211 to 216 ejects ink of a corresponding color. Printing data on a printing medium 900 is performed by having the ejection heads 211 to 216, the carriage driving section 240, and the transport section 250 of the printing mechanism unit 120 work together based on a direction from the main control unit 110.

Figure 3:
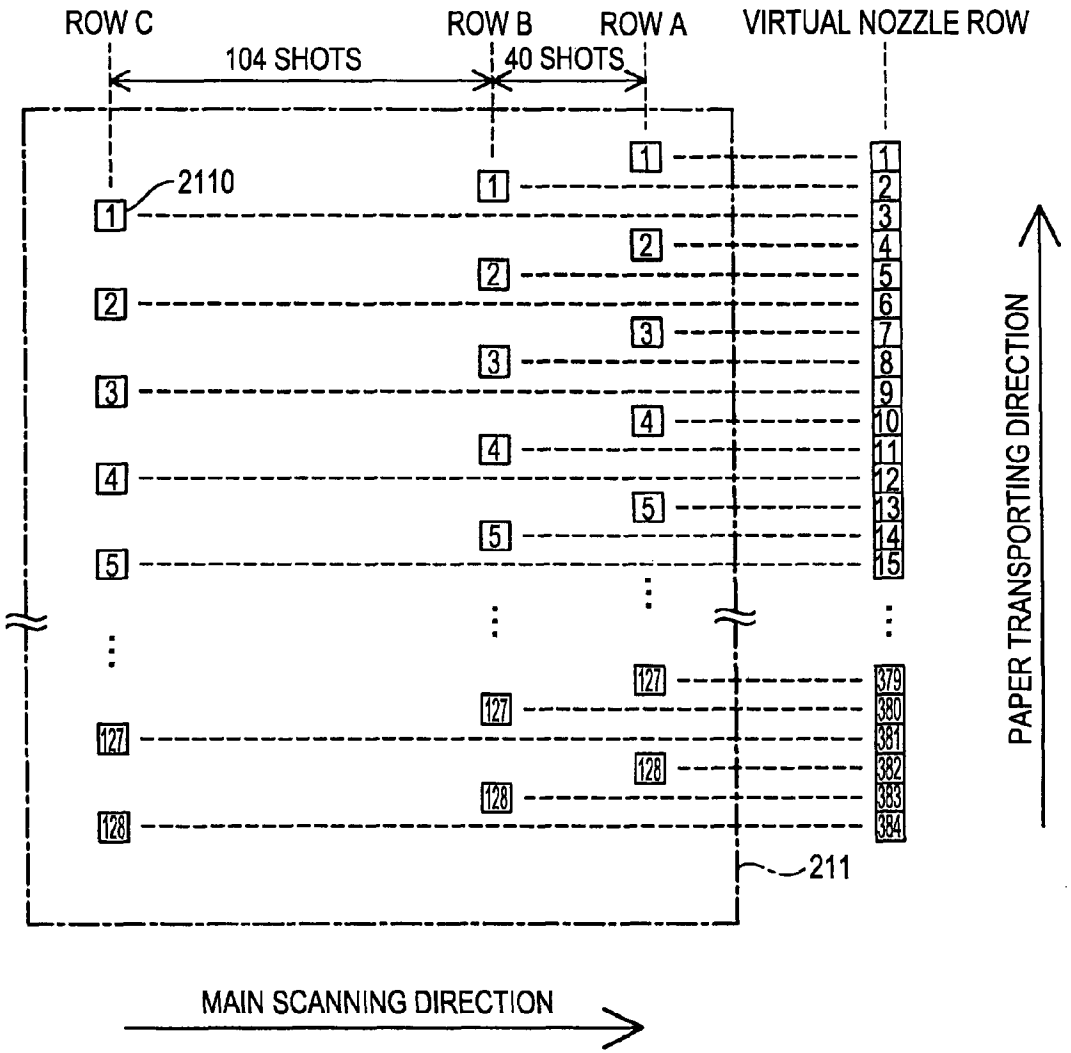
FIG. 3 is a schematic explanatory diagram showing the dispositional configuration of an ejection head 211 of the printer 10.

FIG. 3 is a schematic explanatory diagram showing the dispositional configuration of the ejection head 211 of the printer 10. The ejection head 211 includes a nozzle row formed by aligning a plurality of nozzles 2110 that ejects ink commonly supplied from the ink cartridge 220. In addition, ejection and stop of the ejection are controlled by adjusting voltages of piezo elements (not shown) corresponding to a plurality of nozzles 2110. According to this embodiment, the nozzle 2110 can form ejection dots of three types including a large dot, a medium dot, and a small dot.

In FIG. 3, an appearance in which the dispositional configuration of the nozzles 2110 of the ejection head 211 is projected on a printing medium 900 is shown. According to this embodiment, the ejection head 211 has three nozzle rows, which are formed by row A, row B, and row C in which a plurality of the nozzles 2110 is aligned, to be in parallel with one another. According to this embodiment, row A, row B, and row C are sequentially aligned from a side facing the main scanning direction. Thus, row A and row B are spaced apart by 40 shots, that is, 40 dots in the main scanning direction, and row B and row C are spaced apart by 104 shots, that is, 104 dots in the main scanning direction.

In three nozzle rows of row A, row B, and row C, a plurality of nozzles 2110 is formed to be equally spaced. Three nozzle rows of row A, row B, and row C are arranged to be deviated by one third of the pitch of the nozzles 2110 in the row direction. Accordingly, a nozzle row in which the plurality of nozzles 2110 of three nozzle rows of row A, row B, and row C is aligned in a straight line is formed virtually. According to this embodiment, in three nozzle rows of row A, row B, and row C, the plurality of nozzles 2110 is formed at the pitch of 1080 dpi (dots per inch, hereinafter, denoted by "dpi"). In addition, three nozzle rows of row A, row B, and row C are arranged to be deviated by 360 dpi in the row direction. According to this embodiment, three nozzle rows of row A, row B, and row C have 128 nozzles 2110, respectively. Accordingly, a nozzle row in which a total of 384 nozzles 2110 are aligned in a straight line is formed virtually.

Ink ejected from the plurality of nozzles 2110 is formed on a printing medium 900 as ejection dots aligned along the nozzle row in units of nozzle rows. According to this embodiment, 384 ejection dots ejected from the plurality of nozzles 2110 of three nozzle rows of row A, row B, and row C are formed as ejection dots in units of nozzle rows. By sequentially forming the ejection dots in units of nozzle rows so to be deviated in the main scanning direction, a raster area in which a plurality of the ejection dots formed in units of nozzle rows is aligned in the main scanning direction is formed on the printing medium 900. According to this embodiment, the dispositional configurations of the ejection heads 212, 213, 214, 215, and 216 corresponding to ink of the cyan color, the light cyan color, the magenta color, the light magenta color, and the yellow color are the same as the dispositional configuration of row A of the ejection head 211 corresponding to ink of the black color shown in FIG. 3. According to this embodiment, in a color printing mode in which a printing operation is performed by using ink of colors, the printing operation is performed by using only the row A among three nozzle rows of row A, row B, and row C that eject black ink. In addition, in a black and white printing mode in which a printing operation is performed by mainly using black ink, the printing operation is performed by using three nozzle rows of row A, row B, and row C that eject the black ink.

Figure 4:
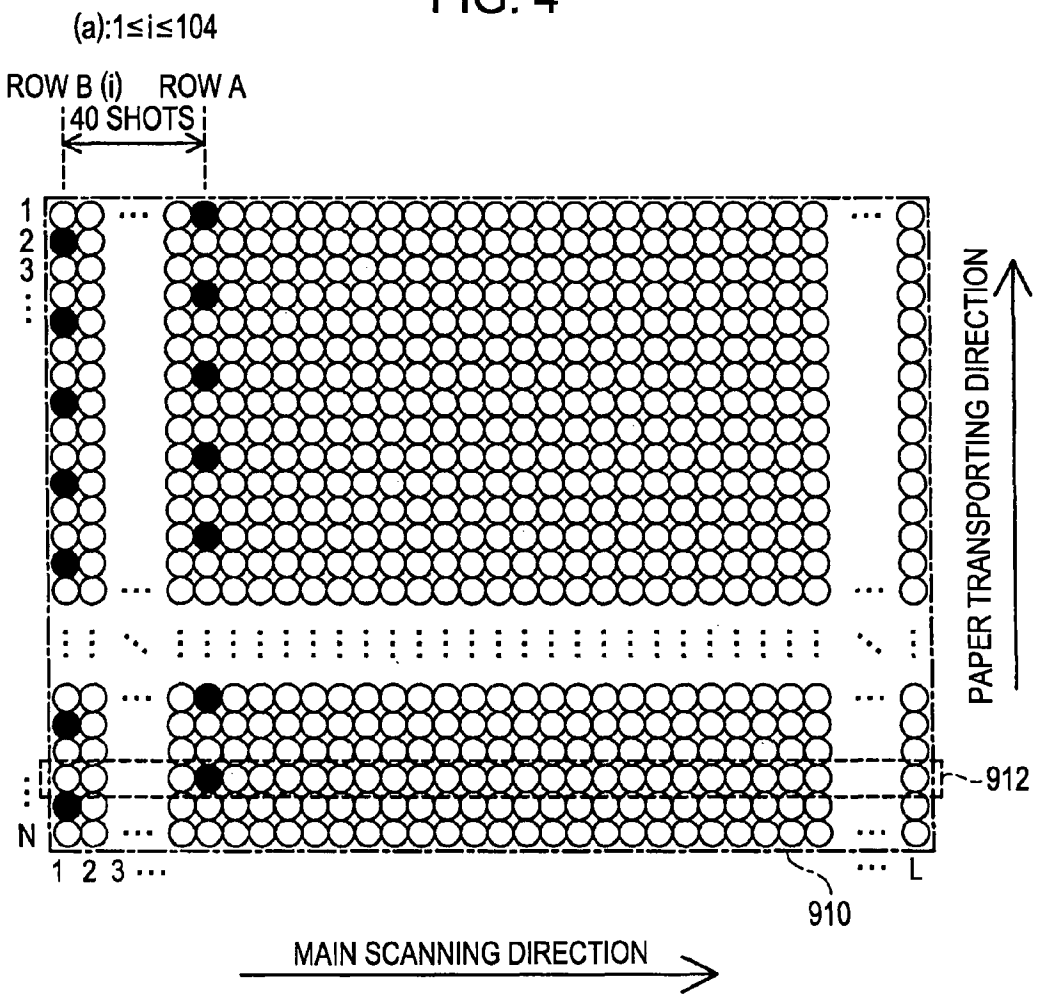
FIG. 4 is an explanatory diagram showing an appearance of forming ejection dots in units of nozzle rows in row A and row B according to an embodiment of the invention.

FIG. 4 is an explanatory diagram showing an appearance of forming the ejection dots in units of nozzle rows in row A and row B. In FIG. 4, a raster area 910 that is formed by performing a main scanning operation once is schematically denoted by white circles and black circles. In FIG. 4, the black circle represents the position of an ejection dot that is formed in a position of the ejection head 211 shown in FIG. 4. In addition, the white circle represents an ejection dot that is formed for a case where the ejection head 211 is located in a different position. The raster area 910 is configured by a plurality of rasters 912 in which ejection dots are aligned in one row in the main scanning direction. According to this embodiment, 384 rasters 912 corresponding to 384 nozzles 2110 are formed in the raster area 910. In FIG. 4, the raster area 910 has "N" ejection dots in the paper transporting direction and has "L" ejection dots in the main scanning direction. As a result, the raster area 910 has a total of "N×L" ejection dots. In FIG. 4, an appearance of forming the ejection dots in units of nozzle rows for a case where the row position "i" of row B is "1≤i≤104", that is, a case where row B is formed from the 1st row to the 104th row is shown. In such a case, ejection dots are formed in row A and row B, and ink-ejection is stopped in row C.

Figure 5:
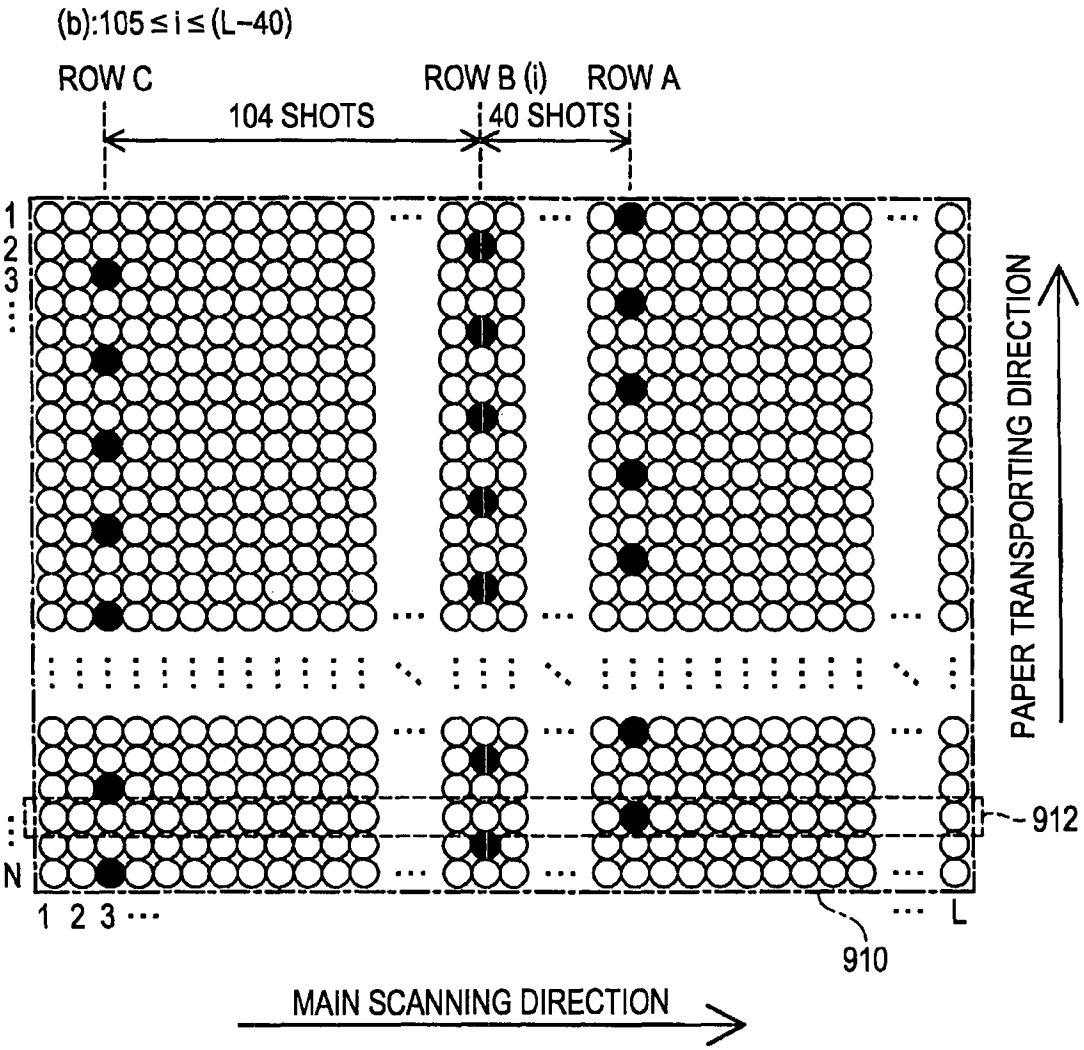
FIG. 5 is an explanatory diagram showing an appearance of forming ejection dots in units of nozzle rows in row A, row B, and row C according to an embodiment of the invention.

FIG. 5 is an explanatory diagram showing an appearance of forming ejection dots in units of nozzle rows in row A, row B, and row C. The raster area 910 shown in FIG. 5 is represented in a form that is the same as that shown in FIG. 4. In FIG. 5, an appearance of forming the ejection dots in units of nozzle rows for a case where the row position "i" of row B is "105≤i≤(L−40)", that is, a case where row B is formed from the 105th row to the (L−40)-th row is shown. In such a case, ejection dots are formed in all the nozzle rows of row A, row B, and row C.

Figure 6:
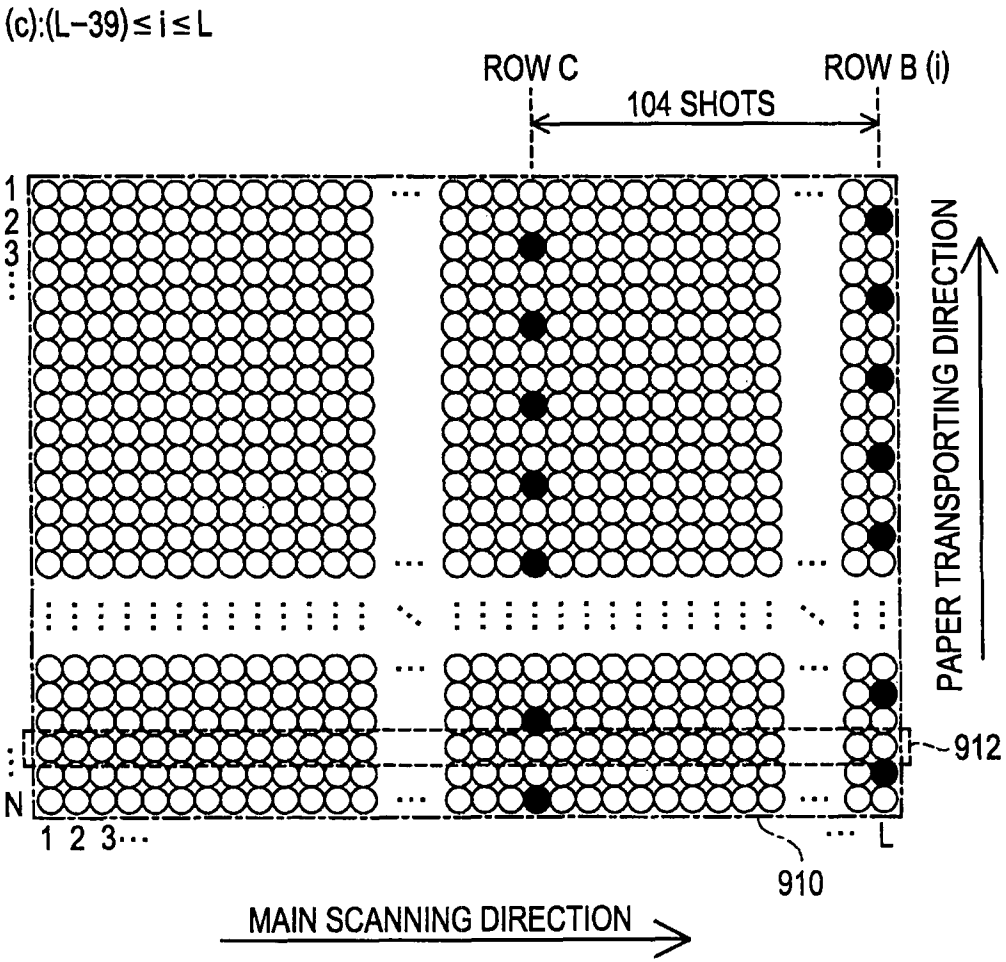
FIG. 6 is an explanatory diagram showing an appearance of forming ejection dots in units of nozzle rows in row B and row C according to an embodiment of the invention.

FIG. 6 is an explanatory diagram showing an appearance of forming ejection dots in units of nozzle rows in row B and row C. In FIG. 6, the raster area 910 is represented in a form that is the same as that shown in FIG. 4. In FIG. 6, an appearance of forming the ejection dots in units of nozzle rows for a case where the row position "i" of row B is "(L−39)≤i≤L", that is, a case where row B is formed from the (L−39)-th row to the L-th row is shown. In such a case, ejection dots are formed in all the nozzle rows of row B and row C, and ink-ejection is stopped in row A.

Returning back to FIG. 2, the main control unit 110 of the printer 10 includes a print data acquiring section 310, a printing control section 370, an ejection amount calculating section 320, and a division scanning section 330. The print data acquiring section 310 of the main control unit 110 acquires print data from a memory card 810 that is connected to the card slot 140 or an external device 820 that is connected to the communication connector 150.

The printing control section 370 of the main control unit 110 directs the printing mechanism unit 120 to print the print data. The printing control section 370 includes an ejection control part 372 and a scanning control part 374. The ejection control part 372 of the printing control section 370 controls the head unit 210 such that ejection dots in units of nozzle rows, which are based on the print data acquired by the print data acquiring section 310, are formed on the printing medium 900. The scanning control part 374 of the printing control section 370 controls the carriage driving section 240 and the transport section 250 such that the raster area 910 on the basis of the print data acquired by the print data acquiring section 310 is formed on the printing medium 900.

The ejection amount calculating section 320 of the main control unit 110 calculates the amounts of ejection of ink needed for forming ejection dots in units of nozzle rows for each ejection dot in units of nozzle rows configuring the raster area 910. The division scanning section 330 of the main control unit 110 forms the raster area 910 to be divided by performing a plurality of main scanning operations in accordance with the transitional change of the ejection amounts that is formed by aligning the amounts of ejection calculated by the ejection amount calculating section 320 in the order in which ejection dots in units of nozzle rows are formed.

According to this embodiment, the main control unit 110 of the printer 10 has ASICs (Application Specific Integrated Circuits) having hardware such as a central processing unit (hereinafter, referred to as a CPU), a read only memory (hereinafter, referred to as a ROM), and a random access memory (hereinafter, referred to as a RAM). According to this embodiment, in the main control unit 110, software that is used for implementing functions of the print data acquiring section 310, the printing control section 370, the ejection amount calculating section 320, and the division scanning section 330 is installed. The operation of the main control unit 110 will be described later in detail.

A2. Operation Of Printer

A2-1. Image Printing Process

Figure 7:
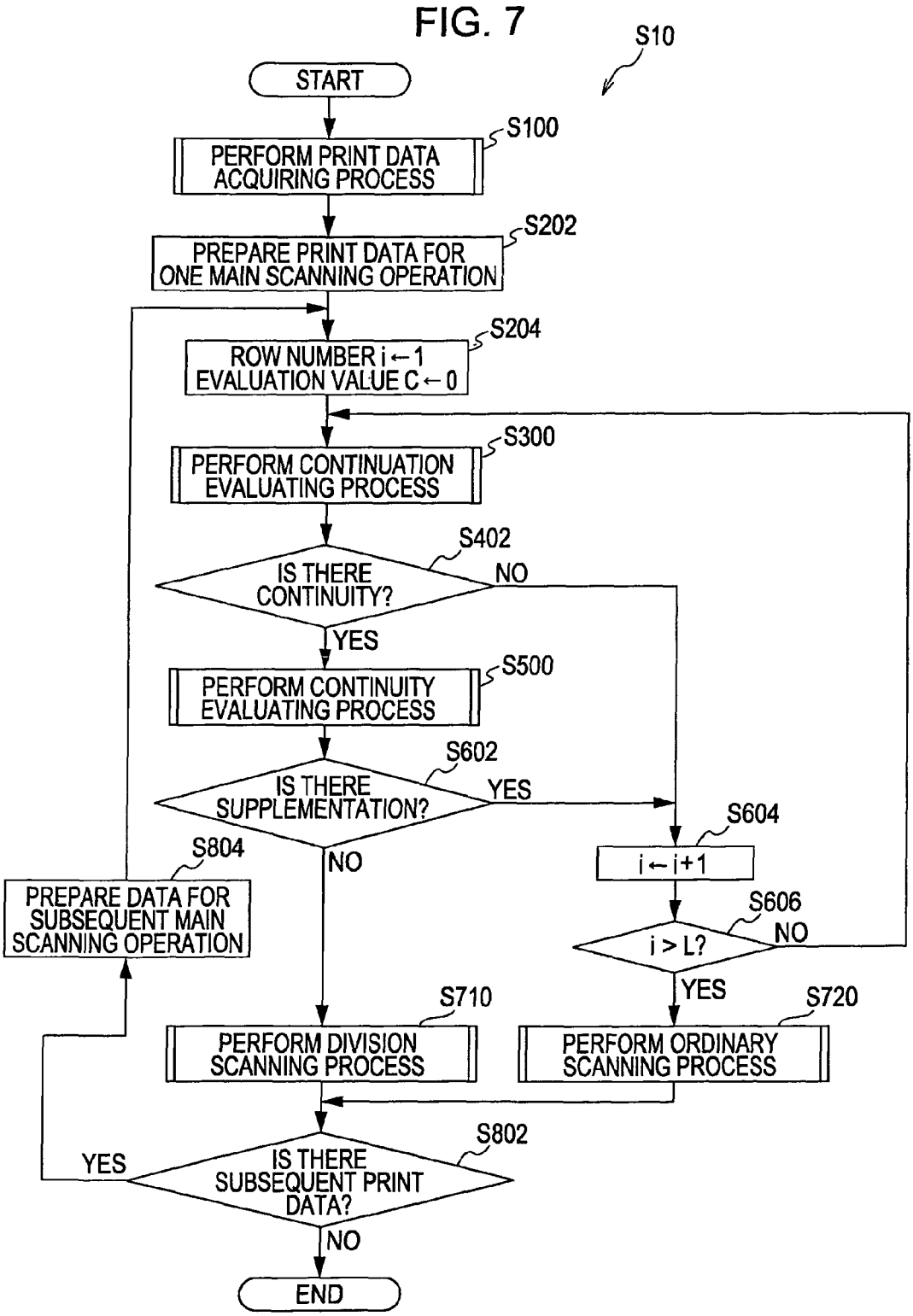
FIG. 7 is a flowchart showing an image printing process (Step S10) that is performed by a main control unit 110 of the printer 10.

FIG. 7 is a flowchart showing an image printing process (Step S10) that is performed by the main control unit 110 of the printer 10. According to this embodiment, when a print request is received from the external device 820 that is connected to the communication connector 150 or when a print request for image data that is stored in the memory card 810 connected to the card slot 140 or the external device 820 connected to the communication connector 150 is received from a user using the printer 10 through the operation panel 170, the main control unit 110 of the printer 10 starts the image printing process (Step S10). According to this embodiment, the image printing process (Step S10) is performed in a black and white print mode in which a printing operation is performed by mainly using black ink. According to this embodiment, the image printing process (Step S10) is implemented by the operation of the CPU of the main control unit 110 that is performed based on software. However, as a different embodiment, the image printing process may be implemented by the operation of the electronic circuit of the main control unit 110 that is performed based on the physical circuit configuration thereof.

When starting the image printing process (Step S10), the main control unit 110 of the printer 10 performs a print data acquiring process (Step S100) by operating as a print data acquiring section 310. In the print data acquiring process (Step S100), the main control unit 110 acquires the print data through the card slot 140 or the communication connector 150. Thereafter, the main control unit 110 prepares print data for performing one main scanning operation based on the print data that is acquired in the print data acquiring process (Step S100) (Step S202).

After the print data for one main scanning operation is prepared (Step S202), the main control unit 110 sets the row number "i" to "one" and sets an evaluation value C, which is used for evaluating the transitional change in the amount of ejection of ink needed for the ejection dots in units of nozzle rows, to "zero" (Step S204). Thereafter, the main control unit 110 performs a continuation evaluating process, which is used for evaluating whether there is continuation in the transitional change in the amount of ejection of ink, for print data for one main scanning operation (Step S300). The continuation evaluating process (Step S300) will be described later in detail.

When it is determined that there is continuity of the transitional change in the amount of ejection of ink in the continuity evaluating process (Step S300) (Step S402: "YES"), the main control unit 110 performs a supplementation evaluating process (Step S500). In the supplementation evaluating process (Step S500), the main control unit 110 determines whether there is supplementation in which sufficient ink can be supplied to the head unit 210 after the transitional change having continuity in print data for one main scanning operation. The supplementation evaluating process (Step S500) will be described later in detail.

On the other hand, when it is determined that there is no supplementation in which sufficient ink can be supplied to the head unit 210 in the supplementation evaluating process (Step S500) (Step S602: "NO"), the main control unit 110 performs a division scanning process by operating as the division scanning section 330 (Step S710). In the division scanning process (Step S710), the main control unit 110 forms the raster area 910 for one main scanning operation, which is under determination, to be divided into a plurality of main scanning areas. The division scanning process (Step S710) will be described later in detail.

On the other hand, when it is determined that there is no continuity of the transitional change in the amount of ejection of ink in the continuity evaluating process (Step S300) (Step S402: "NO"), if it is determined that there is the supplementation, in which sufficient ink can be supplied to the head unit 210, in the supplementation evaluating process (Step S500) (Step S602: "YES"), the main control unit 110 adds one to the row number i, that is, performs increment for the row number i (Step S604). Thereafter, when the row number i does not exceed the final row L of the raster area 910 (Step S606: "NO"), the main control unit 110 repeatedly performs the process started from the continuation evaluating process (Step S300). On the other hand, when the row number i exceeds the final row L of the raster area 910 (Step S606: "YES"), the main control unit 110 performs an ordinary scanning process (Step S720) in which a raster area 910 for one main scanning operation under determination is formed by one main scanning operation without any change.

After the division scanning process (Step S710) or the ordinary scanning process (Step S720) is performed, the main control unit 110 determines whether there is subsequent print data of the print data for one scanning operation of the print data acquired in the print data acquiring process (Step S100) that has not been determined by the continuity evaluating process (Step S300) and the supplementation evaluating process (Step S500) (Step S802). When there is print data that has not been determined (Step S802: "YES"), the main control unit 110 performs a same determining process for the subsequent print data (Step S804). On the other hand, when there is no subsequent print data that has not been determined (Step S802: "NO"), the main control unit 110 completes the image printing process (Step S10). In addition, in the color printing mode in which a printing operation is performed by using ink of colors, instead of the image printing process (Step S10) shown in FIG. 7, an image printing process in which a printing operation is performed without performing the continuity evaluating process (Step S300), the supplementation evaluating process (Step S500), the division scanning process (Step S710), and processes related thereto is performed. Accordingly, in the color printing mode in which a printing operation is performed by using only the row A for the black ink, there is low possibility that the black ink is refilled late. Accordingly, the process load for the image printing process can be reduced by omitting the continuity evaluating process (Step S300), the supplementation evaluating process (Step S500), and the division scanning process (Step S710).

A2-2. Continuity Evaluating Process

Figure 8:
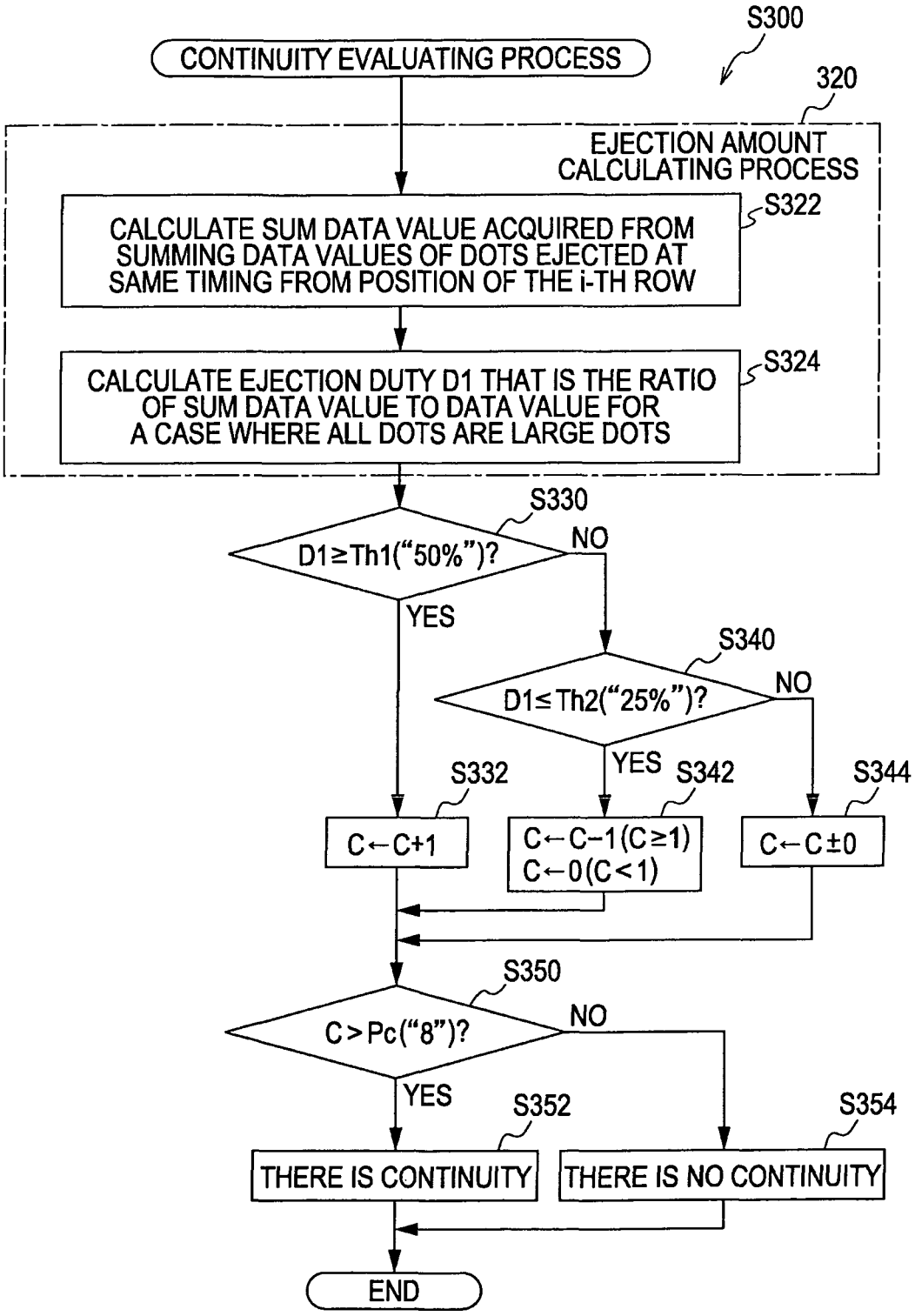
FIG. 8 is a flowchart showing a detailed continuity evaluating process (Step S300) of the image printing process (Step S10).

FIG. 8 is a flowchart showing a detailed continuity evaluating process (Step S300) of the image printing process (Step S10). When starting the continuity evaluating process (Step S300), the main control unit 110 of the printer 10 performs the ejection amount calculating process by operating as the ejection amount calculating section 320 (Step S320).

In the ejection amount calculating process (Step S320), the main control unit 110 calculates a sum data value acquired from summing data values of ink ejected at a same timing from the head unit 210 for a case where a nozzle row of row B is positioned in the "i"-th row (Step S322). For example, as shown in FIG. 4, when the row number i is "$1 \leq i \leq 104$", a sum data value acquired from summing data values for forming ejection dots in row A and row B is calculated. For example, as shown in FIG. 5, when the row number i is "$105 \leq i \leq (L-40)$", a sum data value acquired from summing data values for forming ejection dots in row A, row B, and row C is calculated. In addition, for example, as shown in FIG. 6, when the row number i is "$(L-39) \leq i \leq L$", a sum data value acquired from summing data values for forming ejection dots in row B and row C is calculated. According to this embodiment, a data value corresponding to a large dot is "4", a data value corresponding to a medium dot is "2", a data value corresponding to a small dot is "1", and a data value corresponding to stop of ejection is "0". In addition, the amounts of ejection for forming the ejection dots are set.

After the sum data value is calculated (Step S322), the main control unit 110 calculates ejection duty D1 that is a ratio of the calculated sum data value to a sum data value for a case where all the ejection dots in row A, row B, and row C are large dots (Step S324). For example, the ejection duty D1 for a case where all the ejection dots in row A, row B, and row C are large dots is 100%. In addition, the ejection duty D1 for a case where all the ejection dots in row A, row B, and row C are in the ejection-stop state is 0%. According to this embodiment, the data value corresponding to a large dot is "4", the data value corresponding to a medium dot is "2", and the data value corresponding to a small dot is "1". Accordingly, the ejection duty D1 for a case where all the ejection dots in row A, row B, and row C are medium dots is 50%, and the ejection duty D1 for a case where all the ejection dots in row A, row B, and row C are small dots is 25%.

After the ejection amount calculating process (Step S320) is performed, the main control unit 110 determines whether the ejection duty D1 is equal to or larger than a threshold value Th1 (Step S330). According to this embodiment, the threshold value Th1 is set to 50%. However, the threshold value Th1 may be appropriately set based on the specification of the printer 10, in particular, the configurations of the ink cartridges 220 and 230, the configuration of the head unit 210, and the characteristics of ink. When the ejection duty D1 is equal to or larger than the threshold value Th1 (Step S330: "YES"), the main control unit 110 adds "one" to the evaluation value C, that is, performs increment for the evaluation value C (Step S332).

On the other hand, when the ejection duty D1 is smaller than the threshold value Th1 (Step S330: "NO"), the main control unit 110 determines whether the ejection duty D1 is equal to or smaller than a threshold value Th2 (Step S340).

According to this embodiment, the threshold value Th2 is set to 25%. However, the threshold value Th2 may be appropriately set based on the specification of the printer 10, in particular, the configurations of the ink cartridges 220 and 230, the configuration of the head unit 210, and the characteristics of ink. When the ejection duty D1 is equal to or larger than the threshold value Th2 (Step S340: "YES"), the main control unit 110 subtracts "one" from the evaluation value C, that is, performs decrement for the evaluation value C for a case where the evaluation value C is equal to or larger than "one", and the main control unit 110 sets the evaluation value C to "zero" for a case where the evaluation value C is smaller than "one" (Step S342).

When the ejection duty D1 is smaller than the threshold value Th1 and is larger than the threshold value Th2 (Step S340: "NO"), the main control unit 110 maintains the evaluation value C at the current value (Step S344).

After reflecting the value of the ejection duty D1 on the evaluation value C (Steps S322, S342, and S344), the main control unit 110 determines whether the evaluation value C is larger than a continuity determining value Pc (Step S350). According to this embodiment, the continuity determining value Pc is set to "eight". However, the continuity determining value Pc may be appropriately set based on the specification of the printer 10, in particular, the configurations of the ink cartridges 220 and 230, the configuration of the head unit 210, and the characteristics of ink.

When the evaluation value C is larger than the continuity determining value Pc (Step S350: "YES"), the main control unit 110 determines that there is continuity of the transitional change in the amount of ejection of ink (Step S352). On the other hand, when the evaluation value C is equal to or smaller than the continuity determining value Pc (Step S350: "NO"), the main control unit 110 determines that there is no continuity of the transitional change in the amount of ejection of ink (Step S354).

A2-3. Supplementation Evaluating Process

Figure 9:
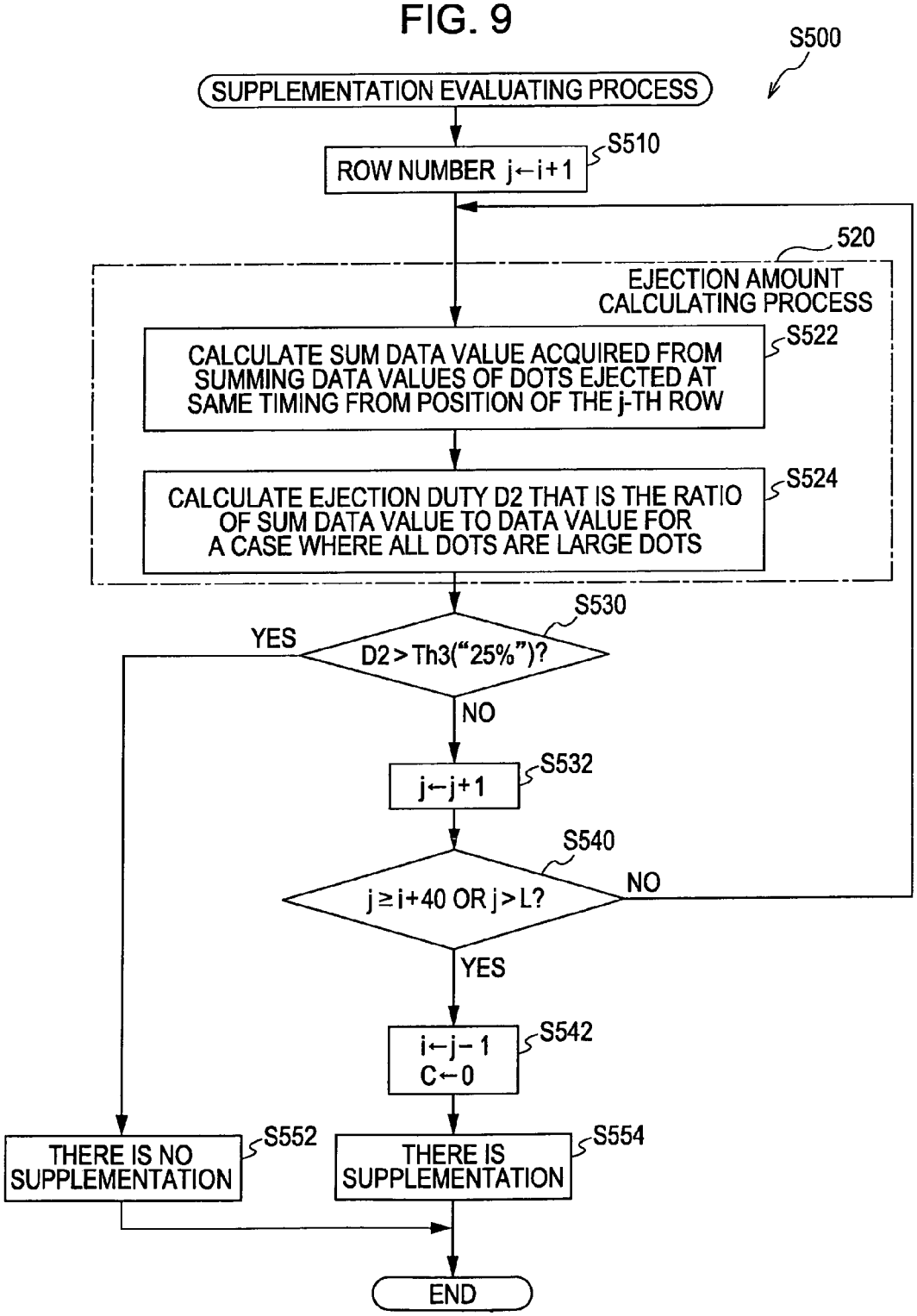
FIG. 9 is a flowchart showing a detailed supplementation evaluating process (Step S500) of the image printing process (Step S10).

FIG. 9 is a flowchart showing a detailed supplementation evaluating process (Step S500) of the image printing process (Step S10). When starting the supplementation evaluating process (Step S500), the main control unit 110 of the printer 10 sets the row number j that is handled in the supplementation evaluating process (Step S500) to a value acquired from adding "one" to the previous row number i (Step S510). Thereafter, the main control unit 110 performs the ejection amount calculating process by operating as the ejection amount calculating section 320 (Step S520).

In the ejection amount calculating process (Step S520), the main control unit 110 calculates a sum data value acquired from summing data values of ink ejected at a same timing from the head unit 210 for a case where a nozzle row of row B is positioned in the "j"-th row (Step S522). After the sum data value is calculated (Step S522), the main control unit 110 calculates ejection duty D2 that is a ratio of the calculated sum data value to a sum data value for a case where all the ejection dots in row A, row B, and row C are large dots (Step S524).

After the ejection amount calculating process (Step S520) is performed, the main control unit 110 determines whether the ejection duty D2 is larger than a threshold value Th3 (Step S530). According to this embodiment, the threshold value Th3 is set to 25%. However, the threshold value Th3 may be appropriately set based on the specification of the printer 10, in particular, the configurations of the ink cartridges 220 and 230, the configuration of the head unit 210, and the characteristics of ink. When the ejection duty D2 is larger than the threshold value Th3 (Step S530: "YES"), the main control unit 110 determines that there is no supplementation in which sufficient ink can be supplied to the head unit 210 after the transitional change in the amount of ejection of ink having the continuity (Step S552).

On the other hand, when the ejection duty D2 is equal to or smaller than the threshold value Th3 (Step S530: "NO"), the main control unit 110 adds "one" to the row number j, that is, performs increment for the row number j (Step S532). Thereafter, when the row number j is smaller than a value acquired from adding a supply period value R1 to the previous row number i or when the row number j is equal to or smaller than the final row number L (Step S540: "NO"), the main control unit 110 repeatedly performs the process started from the ejection amount calculating process (Step S520). According to this embodiment, the supply period value R1 is set to "40". However, the supply period value R1 may be appropriately set based on the specification of the printer 10, in particular, the configurations of the ink cartridges 220 and 230, the configuration of the head unit 210, and the characteristics of ink.

On the other hand, when the row number j is equal to or lager than the value acquired from adding the supply period value R1 to the previous row number i or when the row number j is larger than the final row number L (Step S540: "YES"), the main control unit 110 sets the row number i to a value acquired from subtracting "one" from the row number j and sets the evaluation value C to "zero" (Step S542). Then, the main control unit 110 determines that there is supplementation in which sufficient ink can be supplied to the head unit 210 after the transitional change in the amount of ejection of ink having the continuity (Step S554).

A2-4. Division Scanning Process

Figure 10:
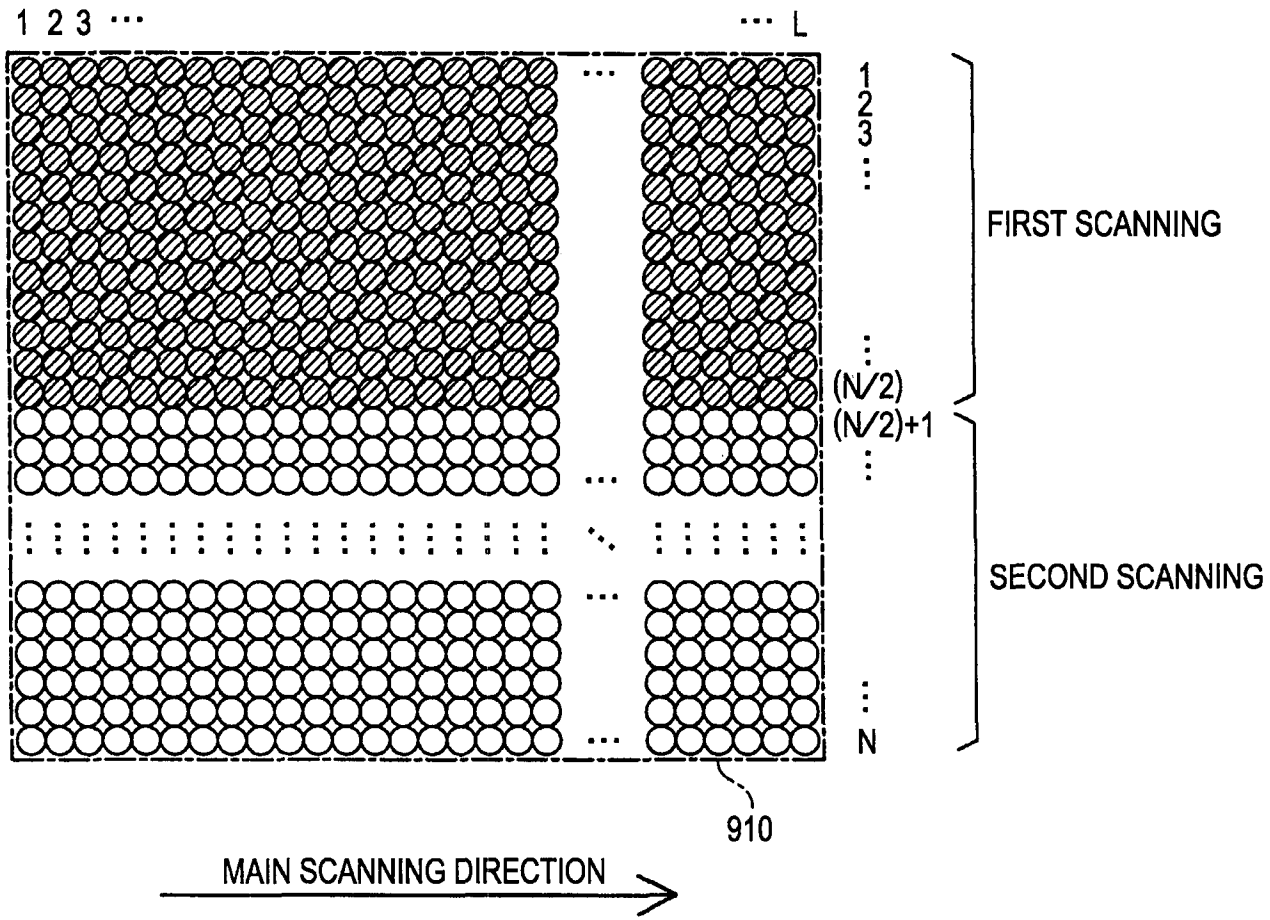
FIG. 10 is an explanatory diagram showing an appearance of performing a division scanning process (Step S710) of the image printing process (Step S10).

FIG. 10 is an explanatory diagram showing an appearance of performing the division scanning process (Step S710) of the image printing process (Step S10). In FIG. 10, a raster area 910 that is formed by dividing one main scanning operation into a first main scanning operation and a second main scanning operation is schematically denoted by shaded circles and white circles. In FIG. 10, a shaded circle represents an ejection dot that is formed by the first main scanning operation, and a white circle represents an ejection dot that is formed by the second main scanning operation following the first main scanning operation. In the example shown in FIG. 10, in the raster area 910 having "N" ejection dots in the paper transporting direction, a raster having ejection dots of the first row to the (N/2)-th row is formed by the first main scanning operation, and a raster having the remaining ejection dots of the (N/2+1)-th row to the N-th row is formed by the second main scanning operation. According to this embodiment, 384 ejection heads are configured in the paper transporting direction in one main scanning operation. Accordingly, a raster of ejection dots of the 1st row to the 192nd row is formed in the first main scanning operation, and a raster of the remaining 193rd to the 384th ejection dots is formed in the second main scanning operation.

A3. Advantages

According to the above-described printer 10 of the first embodiment, the raster area 910, in which a defect of liquid ejection due to delay of refill may occur, is formed by performing a plurality of head scanning operations in accordance with the transitional change in the amount of ejection in the nozzle 2110 (Step S710), the defect of liquid ejection due to delay of refill can be avoided. In addition, by setting the parameters Th1, Th2, Th3, Pc, and R1 based on the refill characteristics of ink for the printer 10, need of division scanning can be determined efficiently. In addition, the raster area 910 is divided in units of the raster 912 in the division scanning process (Step S710), uniformity between the raster area that is formed by a plurality of divided main scanning operations in the division scanning process (Step S710) and the raster area that is formed by one head scanning operation in the ordinary scanning process (Step S720) can be improved.

A4. First Modified Example

Figure 11:
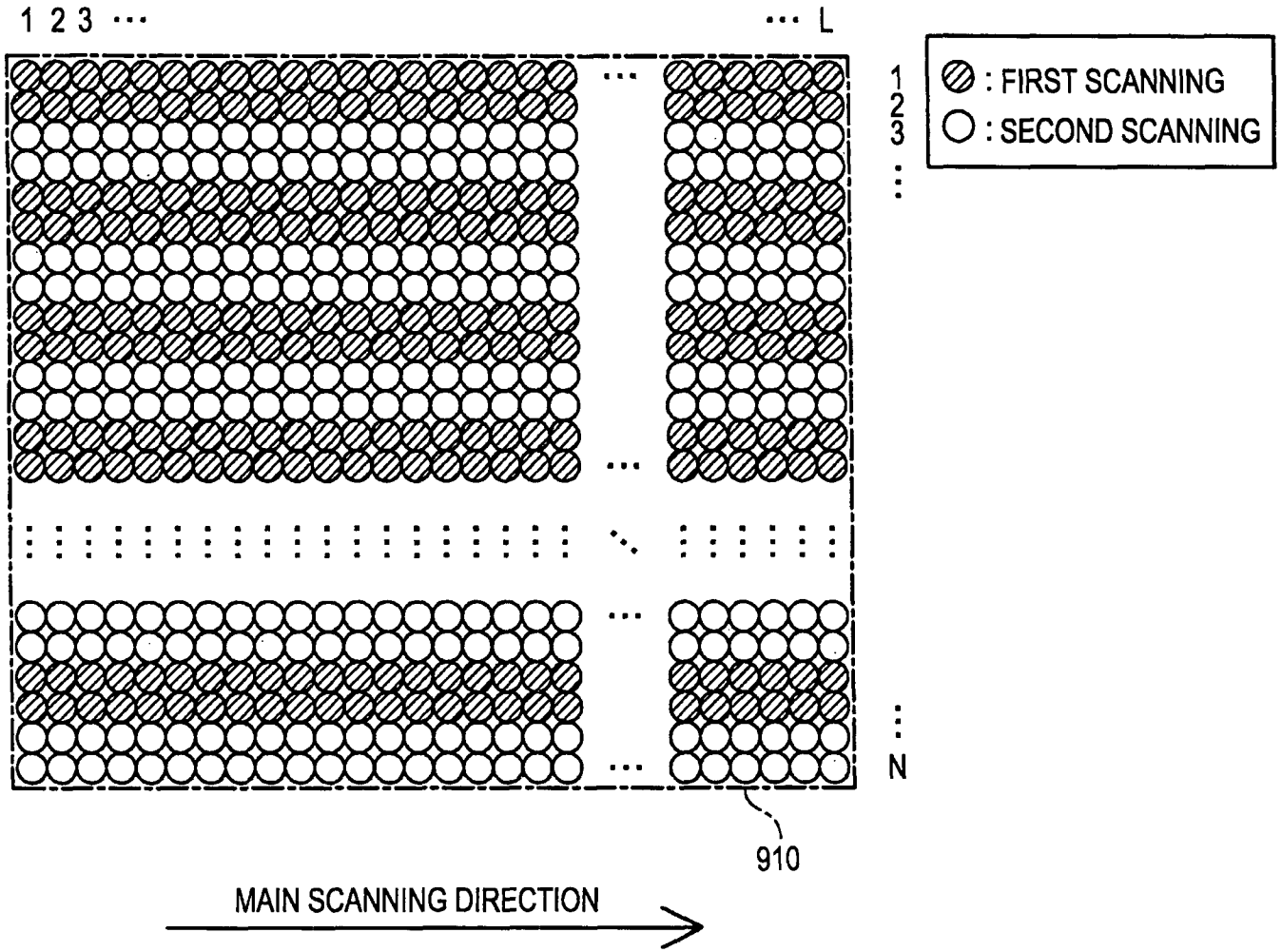
FIG. 11 is an explanatory diagram showing an appearance of performing a division scanning process (Step S710) according to a first modified example of the invention.

In the above-described embodiment, the raster 912 located in the raster area 910 is vertically divided into two in the paper transporting direction in the division scanning process (Step S710). However, as a different embodiment, the raster may be alternately divided with two or more adjacent rasters skipped. FIG. 11 is an explanatory diagram showing an appearance of performing a division scanning process (Step S710) according to a first modified example of the invention. In FIG. 11, a raster area 910 that is formed by diving one main scanning operation into the first main scanning operation and the second main scanning operation is schematically denoted by shaded circles and white circles. In FIG. 11, a shaded circle represents an ejection dot that is formed by the first main scanning operation, and a white circle represents an ejection dot that is formed by the second main scanning operation following the first main scanning operation. In the example shown in FIG. 11, the raster of ejection dots that are formed by the first main scanning operation and the raster of ejection dots that are formed by the second main scanning operation are alternately disposed with two rasters skipped. However, as a different embodiment, the rasters may be configured to be alternately disposed with three or more rasters skipped.

A5. Second Modified Example

Figure 12:
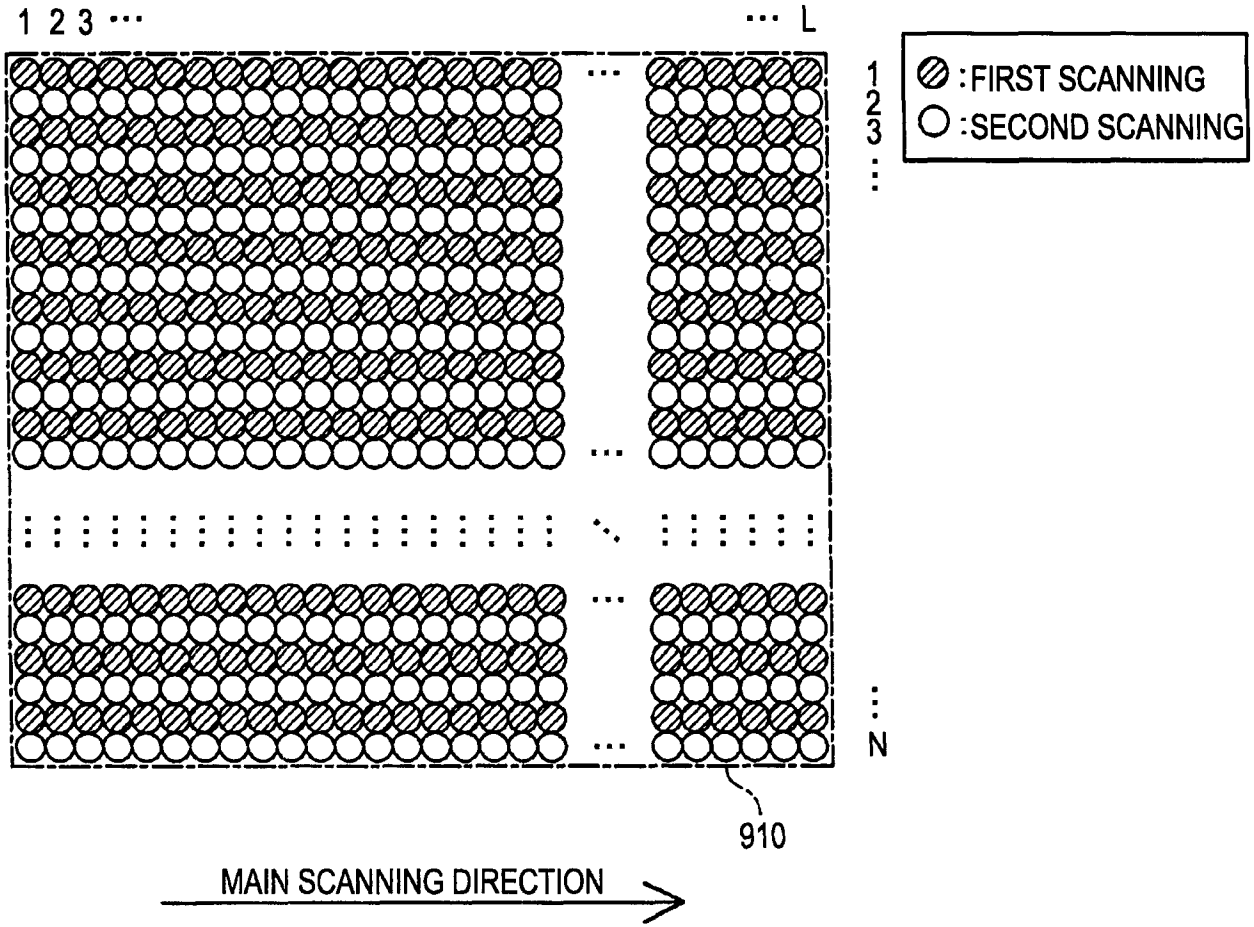
FIG. 12 is an explanatory diagram showing an appearance of performing a division scanning process (Step S710) according to a second modified example of the invention.

In the above-described embodiment, the raster 912 located in the raster area 910 is vertically divided into two in the paper transporting direction in the division scanning process (Step S710). However, as a different embodiment, the raster may be divided with one raster skipped. FIG. 12 is an explanatory diagram showing an appearance of performing a division scanning process (Step S710) according to a second modified example of the invention. In FIG. 12, a raster area 910 that is formed by diving one main scanning operation into the first main scanning operation and the second main scanning operation is schematically denoted by shaded circles and white circles. In FIG. 12, a shaded circle represents an ejection dot that is formed by the first main scanning operation, and a white circle represents an ejection dot that is formed by the second main scanning operation following the first main scanning operation. In the example shown in FIG. 12, the raster of ejection dots that are formed by the first main scanning operation and the raster of ejection dots that are formed by the second main scanning operation are alternately disposed with one raster skipped.

A6. Third Modified Example

Figure 13:
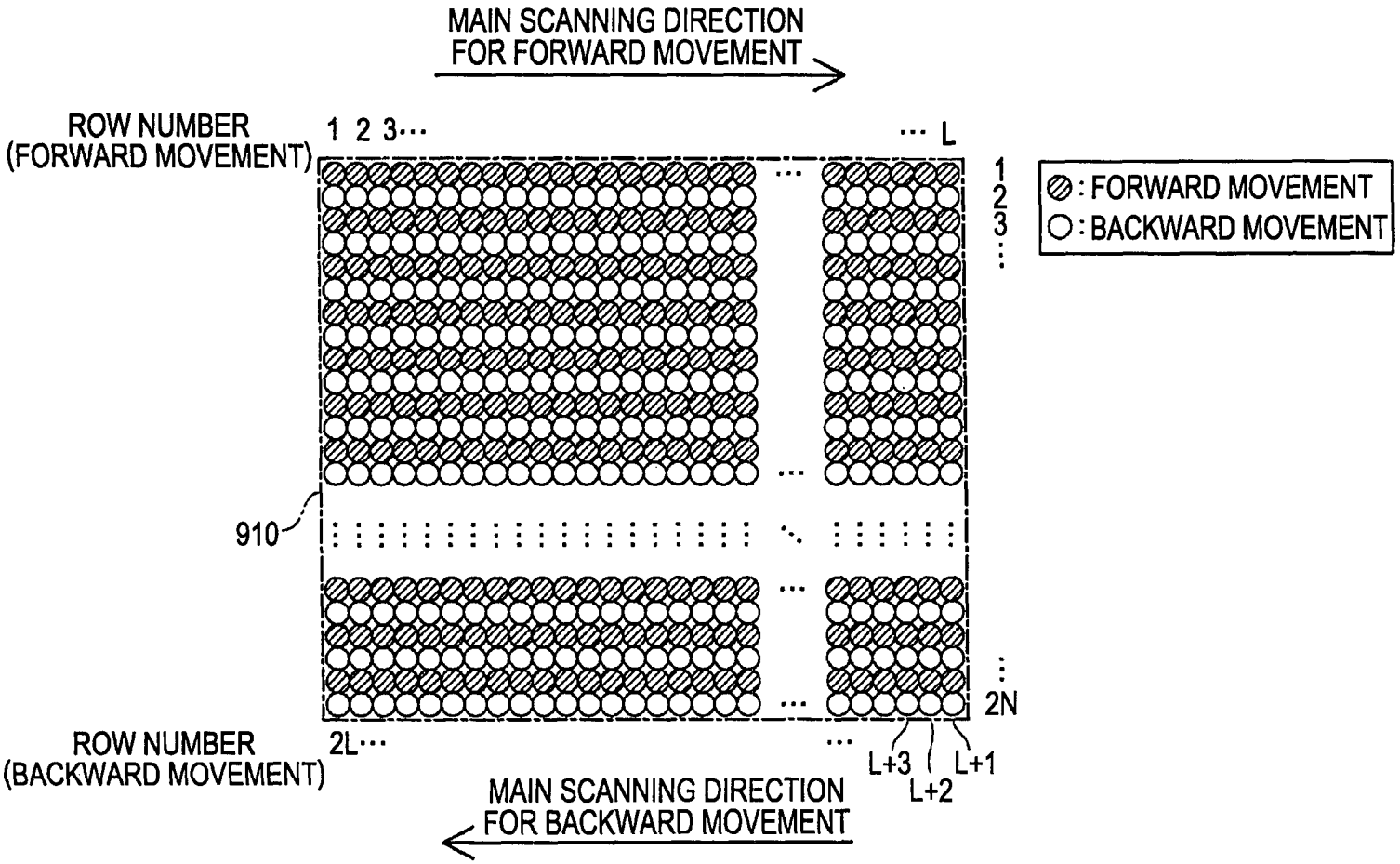
FIG. 13 is an explanatory diagram showing an appearance of forming a raster area 910 by performing a main scanning operation in a reciprocating manner according to a third modified example of the invention.

In the above-described embodiment, an image printing process in which the raster area 910 is formed by a main scanning operation performed in one direction has been described. However, the invention may be applied to an image printing process in which the raster area 910 is formed by a main scanning operation performed in a reciprocating manner, as a different embodiment. FIG. 13 is an explanatory diagram showing an appearance of forming a raster area 910 by performing the main scanning operation in a reciprocating manner. In FIG. 13, the raster area 910 that is formed by performing the main scanning operation in the reciprocating manner is schematically denoted by shaded circles and white circles. In FIG. 13, a shaded circle represents an ejection dot that is formed by the main scanning operation that is performed in the forward movement, and a white circle represents an ejection dot that is formed by the main scanning operation that is performed in the backward movement. In the example shown in FIG. 13, by forming a raster of ejection dots that are formed by the main scanning operation performed in the backward movement between rasters of ejection dots that are formed by the main scanning operation performed in the forward movement, a raster of the ejection dots that are formed by the main scanning operation performed in the forward movement and a raster of the ejection dots that are formed by the main scanning operation performed in the backward movement are alternately disposed with one raster skipped therebetween.

The image printing process (Step S10) of the third modified example is the same as the image printing process (Step S10) of the above-described embodiment except that row numbers formed by performing the main scanning operation in the forward movement are set to "1" to "L", row numbers formed by performing the following main scanning operation in the backward movement is set to "L+1" to "2·L", and the maximum row number is handled as "2·L". In the division scanning process (Step S710) according to the third modified example, at least one between the main scanning operation performed in the forward movement and the main scanning operation performed in the backward movement is divided so as to be performed.

B. Other Embodiments

As above, embodiments of the invention have been described. However, the invention is not limited thereto at all, and it is apparent that the invention may be performed in various forms without departing the gist of the invention. For example, in the above-described embodiments, the raster area 910 is divided into two for two main scanning operations in the division scanning process (Step S710). However, as a different embodiment, the raster area may be divided for two or more scanning operations. In addition, in the above-described embodiments, the raster area 910 is divided into two for two main scanning operations in units of rasters. However, pixels within one raster may be divided for two or more main scanning operations. In addition, in the above-described embodiments, a recording method in which the recording resolution for the nozzle row direction in the raster area 910, in which all the dots are recorded, is the same as the pitch of the nozzles 2110 is used. However, as a different embodiment, a recording method in which the recording resolution for the nozzle row direction in the raster area, in which all the dots are recorded, is higher than the nozzle pitch by storing a raster recorded by one main scanning operation between rasters recorded by another main scanning operation may be used. In addition, according to the above-descried embodiments, the division scanning process (Step S710) is performed for the black ink in the black and white printing mode. However, as a different embodiment, the division scanning process (Step S710) may be performed in a color printing mode. For example, the division scanning process may be performed for a different type of ink or for a plurality of types of ink. In addition, according to the above-described embodiments, nozzle rows corresponding to the black ink are configured by three nozzle rows of row A, row B, and row C. However, as a different embodiment, the division scanning process (Step S710) may be performed by configuring the nozzles row by nozzle rows corresponding to a number other than three, for example, one row, two rows, four rows, five rows, or the like. In addition, in the above-described embodiments, only the nozzle rows corresponding to the black ink is configured by a plurality of nozzle rows. However, as a different embodiment, nozzle rows corresponding to other types of ink may be also configured by a plurality of nozzle rows.

In addition, a liquid targeted by the liquid ejecting apparatus according to an embodiment of the invention is not limited to the above-described ink. Thus, the liquid may be various fluids such as a metal paste, a powder, or a liquid crystal. As a representative example of the liquid ejecting apparatus, there is the above-described ink jet recording apparatus having the ink jet record head for image recording. However, the invention is not limited to the ink jet recording apparatus. Thus, the invention may be applied to an image recording apparatus using a different method, a coloring material ejecting apparatus that is used for manufacturing a color filter of a liquid crystal display or the like, an electrode material ejecting apparatus that is used for forming the electrode of an organic EL (Electro Luminescence) display, a field emission display (FED), or the like, a liquid ejecting apparatus that ejects liquid containing an bioorganic material that is used for manufacturing a bio chip, a test material ejecting apparatus as a precision pipette, or the like.

What is claimed is:

1. A liquid ejecting apparatus that ejects liquid to an ejection target, the liquid ejecting apparatus comprising:

a liquid supplying unit that supplies the liquid;

a head unit that has a nozzle row, in which a plurality of nozzles for ejecting the liquid supplied commonly from the liquid supplying unit is aligned, and forms the liquid ejected from the plurality of nozzles as ejection dots in units of nozzle rows aligned along the nozzle row in the ejection target;

a print data acquiring unit that receives print data to be printed by ejecting a plurality of the ejection dots from the head unit to the ejection target;

a control unit that forms a raster area, in which the plurality of the ejection dots in units of the nozzle rows is aligned in a main scanning direction, in the ejection target for the print data by performing head scanning for moving the head unit relative to the ejection target in the main scanning direction that intersects the nozzle row;

an ejection amount calculating unit that calculates ejection amounts of the liquid needed for forming the plurality of the ejection dots in units of the nozzle rows for each of the plurality of the ejection dots in units of the nozzle rows that configures the raster area, the control unit determining whether or not there is a sufficient amount of the liquid in the liquid supplying unit for the head unit to eject the calculated ejection amounts of the liquid, and the control unit causing the calculated ejection amounts of the liquid to be ejected in response to the control unit determining that there is a sufficient amount of the liquid; and a division scanning unit that, in response to the control unit determining that there is not a sufficient amount of the liquid, divides the raster area so as to be formed by performing a plurality of head scanning operations in accordance with the transitional change in the ejection amounts that is formed by aligning the ejection amounts calculated by the ejection amount calculating unit in the order in which the plurality of the ejection dots in units of nozzle rows are formed, wherein each of the plurality of nozzles can each eject dots in a plurality of sizes;

the control unit determining whether or not there is the sufficient amount of the liquid is based on a size of each of the plurality of the ejection dots to be ejected;

the control unit determining whether or not there is the sufficient amount of the liquid is based on a sum of the sizes;

in a case where all the ejection dots to be ejected are a largest one of the plurality of sizes, the control unit determining weather or not there is the sufficient amount of the liquid is based on a ratio of the calculated ejection amounts to the sum of the sizes;

in a color printing mode, the ejection amount calculating unit does not calculate the ejection amounts of the liquid and the division scanning unit does not divide the raster area; and in a black and white printing mode, the ejection amount calculating unit does calculate the ejection amounts of the liquid and the division scanning unit does not divide the raster area, such that more head scanning operations occur in the black and white printing mode than in the color printing mode.

2. The liquid ejecting apparatus according to claim 1, wherein the division scanning unit includes:

a first determining section that performs increment for an evaluation value used for evaluating the transitional change in the ejection amounts for a case where the ejection amount calculated by the ejection amount calculating unit is equal to or larger than a first threshold value;

a second determining section that performs decrement for the evaluation value for a case where the ejection amount calculated by the ejection amount calculating unit is equal to or smaller than a second threshold value that is smaller than the first threshold value;

a third determining section that maintains the evaluation value at a current value for a case where the ejection amount calculated by the ejection amount calculating unit is smaller than the first threshold value and is larger than the second threshold value; and a fourth determining section unit that divides the raster area so as to be formed by performing a plurality of head scanning operations for a case where the evaluation value added by the first determining section exceeds a predetermined value and an ejection amount exceeding a third threshold value is included in the subsequent ejection amounts, which are calculated by the ejection amount calculating unit, of a predetermined number.

3. The liquid ejecting apparatus according to claim 1, wherein the division scanning unit includes a first division scanning section that divides the raster area for one head scanning operation so as to be formed by performing a plurality of head scanning operations in accordance with the transitional change in the ejection amounts that is formed by aligning the ejection amounts calculated by the ejection amount calculating unit in the order in which the ejection dots in units of the nozzle rows are formed in performing the one head scanning operation.

4. The liquid ejecting apparatus according to claim 1, wherein the control unit forms the raster area in the ejection target by performing the head scanning operation in the reciprocating manner, and wherein the division scanning unit includes a second division scanning section that divides the raster area so as to be formed by performing a plurality of head scanning operations in at least one head scanning operation between a head scanning operation performed in the forward movement and a head scanning operation performed in the backward movement, in accordance with the transitional change in the ejection amounts that is formed by aligning the ejection amounts calculated by the ejection amount calculating unit in the order, in which the ejection dots in units of the nozzle rows are formed, from the head scanning operation in the forward movement to the head scanning operation in the backward movement.

5. The liquid ejecting apparatus according to claim 1, wherein the division scanning unit includes a raster dividing section that divides the raster area, which is divided so as to be formed by performing the plurality of head scanning operations, in units of rasters in which the ejection dots are aligned in one row in the main scanning direction in the raster area.

6. The liquid ejecting apparatus according to claim 5, wherein the raster dividing section divides the raster area that is divided so as to be formed by performing the plurality of head scanning operations with two or more adjacent rasters skipped.

7. The liquid ejecting apparatus according to claim 5, wherein the raster dividing section divides the raster area that is divided so as to be formed by performing the plurality of head scanning operations with one raster skipped.

8. The liquid ejecting apparatus according to claim 1, wherein the control unit causes the calculated ejection amounts of liquid to be ejected from the plurality of nozzles so as to eject the plurality of the ejection dots to the ejection target such that the print data is printed.

9. A liquid ejecting apparatus that ejects liquid to an ejection target, the liquid ejecting apparatus comprising:

a head unit that has a nozzle row, in which a plurality of nozzles supplied commonly from a liquid supplying unit is aligned, and forms ejection dots to the ejection target by ejecting the liquid from the plurality of nozzles;

a print data acquiring unit that receives print data to be printed by ejecting a plurality of the ejection dots from the head unit to the ejection target;

a control unit that performs a head scanning operation for moving the head unit relative to the ejection target in a direction that intersects the nozzle row to form a raster area in which the ejection dots by the plurality of nozzles are aligned in the direction;

an ejection amount calculating unit that calculates ejection amounts of the liquid needed for forming the raster area, the control unit determining whether or not there is a sufficient amount of the liquid in the liquid supplying unit for the head unit to eject the calculated ejection amounts of the liquid, and the control unit causing the calculated ejection amounts of the liquid to be ejected in response to the control unit determining that there is a sufficient amount of the liquid; and a division scanning unit that, in response to the control unit determining that there is not a sufficient amount of the liquid, changes a number of times for the head scanning operation for forming the raster area in accordance with a transitional change in the calculated ejection amounts, wherein each of the plurality of nozzles can each eject dots in a plurality of sizes;

the control unit determining whether or not there is the sufficient amount of the liquid is based on a size of each of the plurality of the ejection dots to be ejected;

the control unit determining weather or not there is the sufficient amount of the liquid is based on a sum of the sizes;

in a case where all of the ejection dots to be ejected are a largest one of the plurality of sizes, the control unit determining whether or not there is the sufficient amount of the liquid is based on a ratio of the calculated ejection amounts to the sum of the sizes;

in a color printing mode, the ejection amount calculating unit does not calculate the ejection amounts of the liquid; and in a black and white printing mode, the ejection amount calculating unit does calculate the ejection amounts of the liquid such that more head scanning operations occur in the black and white printing mode than in the color printing mode.

10. The liquid ejecting apparatus according to claim 9, wherein the head unit has a plurality of nozzle rows, and wherein the ejection amount calculating unit calculates ejection amounts of the liquid needed for forming the raster area by ejecting the liquid from the plurality of nozzle rows.

11. The liquid ejecting apparatus according to claim 10, wherein the plurality of nozzle rows are apart from each other in the direction that intersects the nozzle row.

12. The liquid ejecting apparatus according to claim 11, wherein the head unit forms ejection dots of black ink and color ink.

13. The liquid ejecting apparatus according to claim 9, wherein the head unit has a plurality of nozzles for ejecting a first color ink and a second color ink separately, and wherein the nozzles for ejecting the first color ink outnumber the nozzles for ejecting the second color ink.

14. The liquid ejecting apparatus according to claim 13, wherein the first color ink is black ink.

15. The liquid ejecting apparatus according to claim 9, wherein the division scanning unit changes the number of times for the head scanning operation in the color printing mode but not in the black and white printing mode.

16. The liquid ejecting apparatus according to claim 9, wherein the control unit causes the calculated ejection amounts of liquid to be ejected from the plurality of nozzles so as to eject the plurality of the ejection dots to the ejection target such that the print data is printed.

* * * * *